United States Patent [19]

Hix

[11] 4,176,717

[45] Dec. 4, 1979

[54] CEMENTING TOOL AND METHOD OF UTILIZING SAME

[76] Inventor: Harold A. Hix, 716 N. Poplar, Kermit, Tex. 79745

[21] Appl. No.: 893,185

[22] Filed: Apr. 3, 1978

[51] Int. Cl.[2] ..... E21B 33/13; E21B 33/16

[52] U.S. Cl. ..... 166/289; 166/154; 166/318

[58] Field of Search ..... 166/289, 285, 154, 156, 166/318

[56] References Cited

U.S. PATENT DOCUMENTS

| | | | |
|---|---|---|---|
| 2,161,309 | 6/1939 | O'Donnell | 166/289 X |
| 2,925,865 | 2/1960 | Oliver | 166/154 |
| 2,998,075 | 8/1961 | Clark, Jr. | 166/154 X |
| 3,130,783 | 4/1964 | Orr | 166/289 X |
| 3,228,473 | 1/1966 | Baker | 166/154 |
| 3,338,311 | 8/1967 | Conrad | 166/154 |
| 3,501,201 | 3/1970 | Closmann et al. | 166/272 X |
| 3,527,297 | 9/1970 | Todd | 166/154 |
| 3,768,562 | 10/1973 | Baker | 166/289 |
| 3,789,926 | 2/1974 | Henley et al. | 166/154 X |
| 3,948,322 | 4/1976 | Baker | 166/289 |

*Primary Examiner*—Stephen J. Novosad

*Attorney, Agent, or Firm*—Arnold, White & Durkee

[57] ABSTRACT

A method of and apparatus for cementing the bore hole of oil and gas wells and the like is provided. The apparatus provides a cementing collar threadedly attachable at each end to a well liner and having an inner sleeve slidably positionable within an outer sleeve. The two sleeves are each provided with openings and ports, respectively, which when radially aligned in register permit fluid to flow from the interior of the inner sleeve to the exterior of the outer sleeve. Radial alignment is effected by means of a series of fingers disposed circumferentially at each end on the inner sleeve and receivable at predetermined locations on the interior surface of the outer sleeve. Means are provided for axially moving the inner sleeve to align the openings with the ports and for thereafter disaligning the same.

A method of utilizing the cementing collar apparatus is also provided.

7 Claims, 8 Drawing Figures

FIG.1
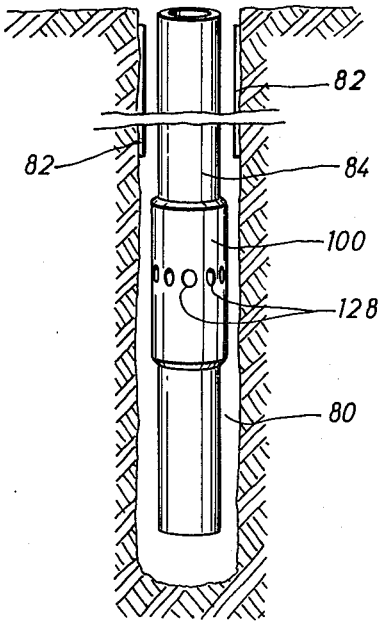
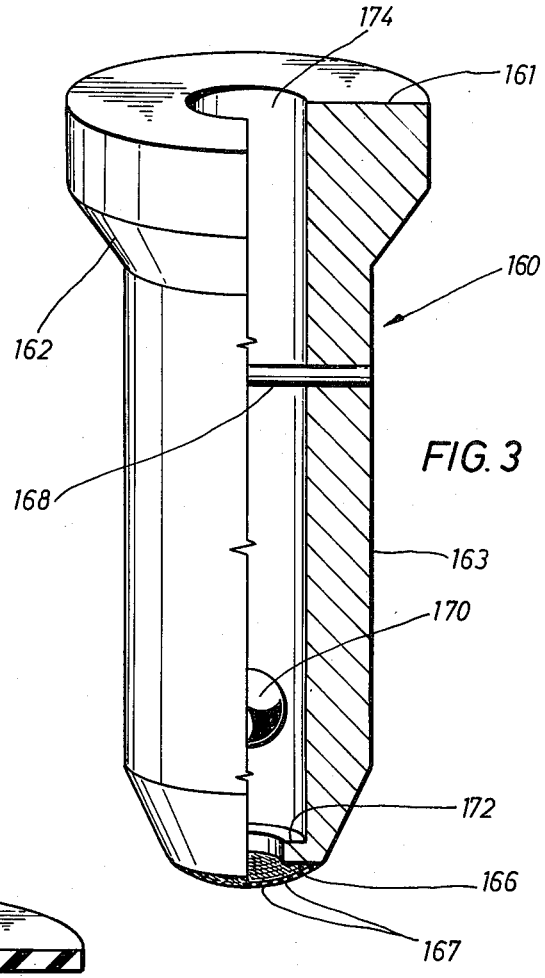
FIG. 3
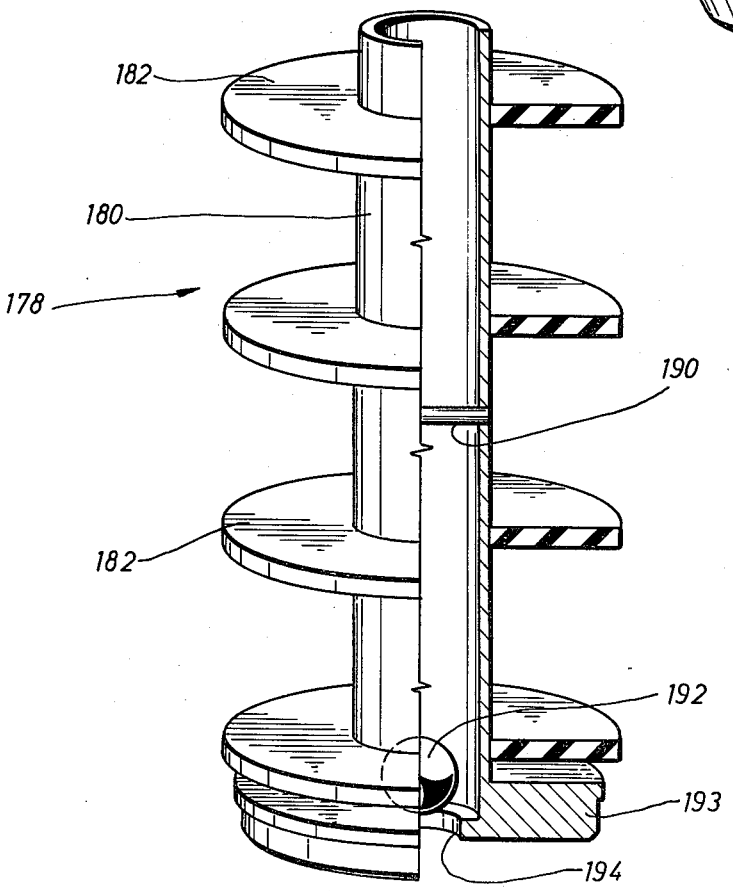
FIG.4

FIG. 2
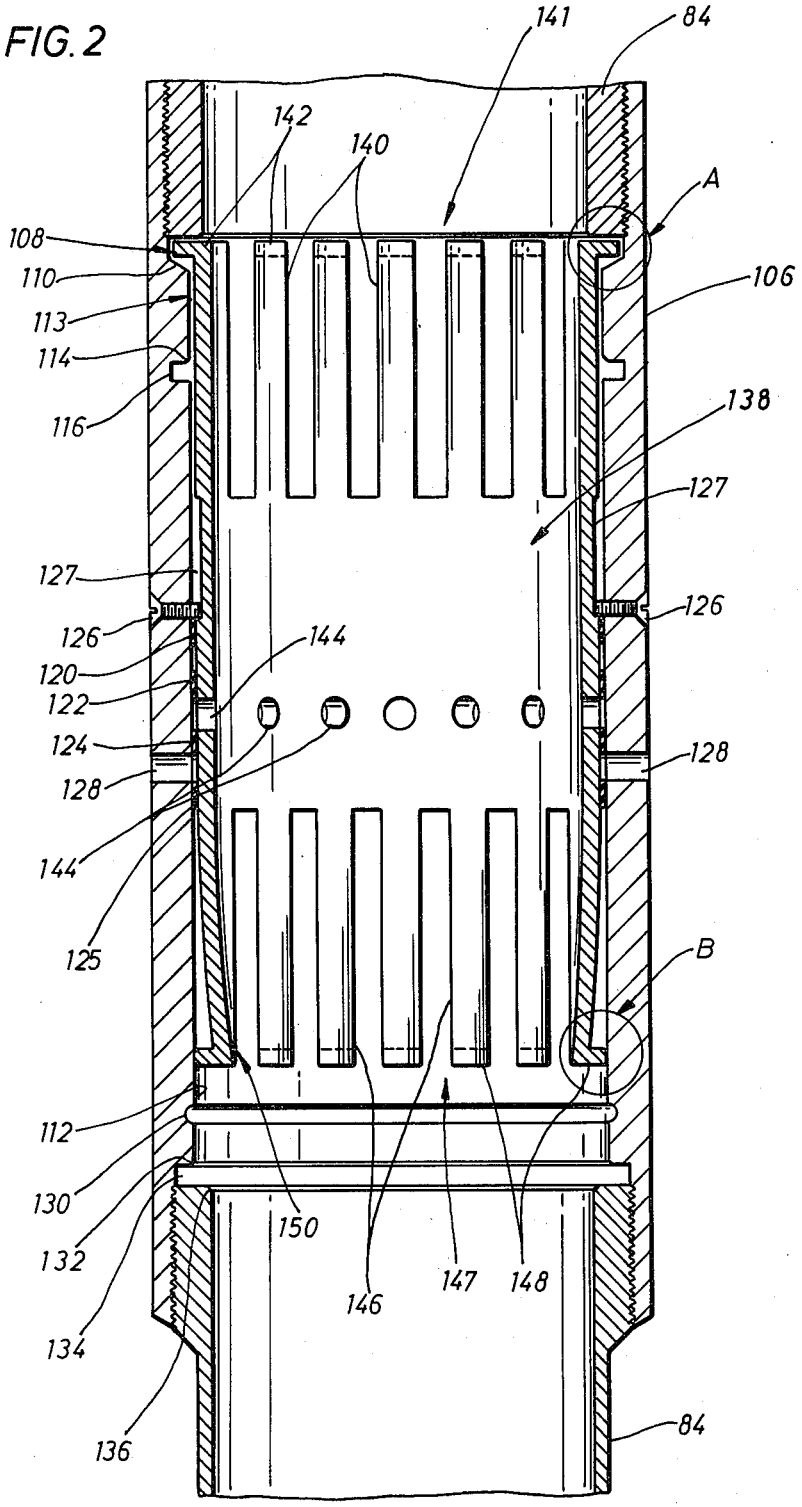
FIG. 2A
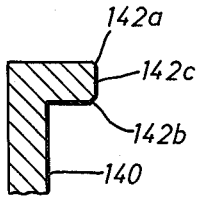
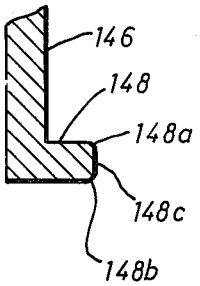
FIG. 2B

CEMENTING TOOL AND METHOD OF UTILIZING SAME

BACKGROUND OF THE PRIOR ART

This invention relates to a cementing collar for use in a string of well liner and actuating means for opening and closing ports in the collar. In particular, this invention is directed to such a collar for use in multiple stage cementing operations of oil and gas wells with the actuating means adapted to be moved down the well casing after performing the actuating functions, thereby eliminating the need for subsequently drilling or milling through these means.

In the drilling and completion of oil or gas wells, it is often desirable to cement a well pipe or casing into the well bore and this is conventionally accomplished by pumping cement slurry down through the casing and out into the annular space between the well bore and the casing. The cement slurry is introduced into the annulus at or near the bottom of the well casing, but if the casing is extremely long or the annulus is small the cement bond and fill at the upper or medium portions of the casing may not be entirely satisfactory. Moreover, occasionally it is highly desirable to obtain a particularly good cement fill and bond in the annulus at a selected upper or medium portion of the casing as well as near the bottom thereof. Thus, it has become customary under these conditions and requirements to perform multiple stage cementing where cement slurry is introduced into the annulus between the casing and the well bore in successive stages at more than one location along the length of the casing.

There are a number of devices known as "cementers" or "cementing collars" which may be used for introducing the cement slurry into the annulus from within the well casing at a particular intermediate point along a well casing. These cementing collars are interposed in the string of the well casing and have normally closed ports which may be opened for permitting the discharge of cement slurry into the annulus and then permanently closed. These opening and closing steps are generally accomplished by dropping or pumping a pair of plugs, bombs or other devices down the well casing to actuate components of the cementing collar. The first device engages a portion of the cementing collar and opens the ports and the second device engages another portion of the cementing collar and closes the ports. These devices are retained in conventional cementing collar and if it is subsequently desired to gain access to the casing below the cementing collar, it is first necessary to drill through these retained devices. Since the particular operation which is to be performed below the cementing collar does not always permit the provision of a drill on the end of a string of pipe being lowered into the casing to perform such operation, this drilling must be conducted as a separate preliminary operation requiring a time-consuming round trip with a drill and string of pipe.

When pumping cement slurry down the casing for these cementing operations, it is conventional and practical to drop a plug into the casing below the cement slurry to open the ports and drop a second plug into the casing on top of the cement slurry to close the ports; these plugs are commonly referred to as "bottom" and "top" plugs, respectively. When multiple stage cementing is carried on the cementing collar must have a large enough minimum internal diameter to permit the top and bottom plugs used in the cementing stages carried on below that collar to pass through the collar without actuating the collar. It is highly desirable that the cementing collar have a minimum internal diameter approximately equal to the internal diameter of the casing both before and after the cementing stage is carried on through that collar so that other tools and devices may be lowered through the collar without the collar presenting any greater obstruction than the casing itself. U.S. Pat. No. 3,768,556 issued to Eugene E. Baker and assigned to Halliburton Company, Duncan, Okla. discloses typical cementing tools currently used in multi-stage cementing operations. Additionally, U.S. Pat. No. 3,228,473, also issued to Eugene E. Baker and assigned Halliburton Company, Duncan, Okla. discloses a cementing collar and means for actuating the same and is a further typical representation of cementing collars. Other patents showing conventional cementing collars would include U.S. Pat. No. 3,789,926, issued to Ronald W. Henley, et al.; U.S. Pat. No. 2,998,075, issued to Earnest H. Clark, Jr., assigned to Baker Oil Tools, Inc., Los Angeles, Calif.; U.S. Pat. No. 2,925,865, issued to Owen and Oliver, assigned to Halliburton Company, Duncan, Okla.; U.S. Pat. No. 3,527,297, issued to William L. Todd, assigned to Jerry L. Pinkard and U.S. Pat. No. 3,338,311, issued to Martin B. Conrad.

It is noted that the above referenced patents, and others, employ the use of shear pins and/or spring actuated contacting means for causing ports located on an inner sleeve to become radially aligned with ports located on an outer sleeve in order to permit the cement slurry to flow outwardly through the radially aligned ports and thereafter up the annulus between the casing and the well bore. Conventionally, the bottom plug as it is dropped through the well casing, contacts the shear pins and/or spring actuators and causes them to be dislodged and upon the application of hydraulic pressure upon the cementing slurry located immediately above the bottom plug the ports become radially aligned.

However, the use of such shear pins and/or spring actuators does not permit the testing of cementing collars utilizing the same without destroying the functional utility of the cementing collar itself. Additionally, such shear pins and/or spring actuators may be subject to premature actuation when in place in a well string and accordingly may hinder the entire drilling operation.

SUMMARY OF THE INVENTION

The present invention overcomes the above-noted and other shortcomings by providing a method and apparatus for use in cementing oil and gas wells and the like wherein hydraulic pressure is used to actuate the apparatus. The apparatus provided is a cementing collar having a slidably disposed inner sleeve responsive to hydraulic pressure for opening and closing circulation ports, thereby eliminating the need for shear pins and/or spring actuator devices and accordingly diminishing the possibility of malfunction during operation.

In one aspect of the apparatus of the present invention, the cementing collar is provided with an outer sleeve threadedly attachable at each end thereof to a well liner. The outer sleeve has a plurality of ports circumferentially distributed about its surface and extending therethrough. The inner surface of the outer sleeve is provided with, at a position axially above the ports, two axially spaced-apart grooves. The inner surface of the outer sleeve is also provided with, at a position axially below the ports, two axially spaced-apart grooves.

In a further feature of the apparatus, an inner sleeve is slidably disposed within the outer sleeve. The inner sleeve is provided with a plurality of openings extending radially therethrough and is also provided with an upper and lower array of resiliently flexible collet fingers extending axially from the inner sleeve. Each finger in the upper and lower array is provided with a head.

In yet another aspect of the present invention, the ports and openings are suitably sized to permit the flow of fluid, such as cement slurry, therethrough.

In yet a further aspect of the invention, the inner sleeve is movably positionable within the outer sleeve from a first locked to an intermediate to a second locked position. Accordingly, with the inner sleeve in the first locked position, the upper heads are received in the first groove and the lower heads abut the interior surface of the outer sleeve at a location above the third groove with the inner surface of the lower fingers thereby defining a holding surface adapted to receive an opening means. With the inner and outer sleeves so positioned the openings and ports are spaced axially out of register.

In another aspect of the present invention, the inner sleeve is movably positioned in the intermediate position. Thus, the upper heads, adapted to receive a closure means, are disposed in abutting relationship to the inner surface of the outer sleeve at a location between the first and second grooves and the lower heads are received in the third groove. So positioned, the ports and openings are radially aligned in register.

With the inner sleeve positioned in the second locked position, the upper heads are received in the second groove and the lower heads are received in the fourth groove. Accordingly, the openings are spaced axially out of register with the ports.

In yet another aspect of the present invention, a locking means is provided for preventing rotation of the inner sleeve with respect to the outer sleeve.

In still another aspect, an opening means is provided for movably positioning the inner sleeve from the first locked position to the intermediate position. The opening means generally comprises an elongated substantially tubular plug with an upper portion thereof having a larger cross-sectional diameter than a lower portion thereof and defining a tapered surface therebetween. The tapered surface is adapted to be received by the holding surface. Additionally, the plug is provided with an axial bore therethrough and contains a first check valve therewithin. The lowermost end of the bore and the plug coincidentially define a fluid opening.

In a further aspect of the invention, a closure means is provided for movably positioning the inner sleeve from the intermediate to the second locked position. The closure means comprises an elongated substantially tubular top plug with a plurality of resiliently flexible wipers circumferentially spaced about the longitudinal axis of the plug. One end of the plug defines a seat adapted for abutting contact on the upper finger heads whenever the inner sleeve is in the intermediate position. The closure plug is also provided with an axial bore existing therethrough and containing a second check valve therewithin.

In one aspect of the method of the present invention, a cementing collar comprising a pair of cylindrical sleeves slidably positioned one within the other is provided threadly attached at each end thereof to a well liner. The sleeves each have a suitable number of spaced portholes adapted to permit the forcing of fluid into the annular space outside the well liner when the portholes in the two sleeves are in register. Initially, the sleeves are situated in a first locked position such that the portholes are aligned circumferentially but not axially. Downward translation of the inner sleeve with respect to the outer sleeve places the inner sleeve is an intermediate position thereby axially aligning the portholes in register thus permitting fluid to flow from the interior of the inner sleeve out of the cementing collar and around the well liner. Further downward translation of the inner sleeve into a second locked position disaligns the portholes.

In a further aspect of the method of the present invention, the inner sleeve is translated into the intermediate position by the action of hydraulic pressure on a generally cylindrically shaped bottom plug which is positioned within the inner sleeve prior to the initiation of the hydraulic pressure.

In another aspect of the invention, the bottom plug is inserted into the well liner and falls freely down the well liner until engagement within the inner sleeve.

In another aspect of the method of the invention, a generally cylindrical top plug is inserted into the well liner and engages the top of the inner sleeve. Hydraulic pressure upon the top plug so positioned causes the inner sleeve to translate downwardly to the second locked position. With the inner sleeve in the second locked position, the bottom plug is free to fall to the bottom of the well. Removal of the top plug is occasioned by pushing the plug to the bottom of the well.

BRIEF DESCRIPTION OF THE DRAWINGS

FIG. 1 shows the apparatus of the present invention included within a string of well casing and inserted into a well bore;

FIG. 2 is a cross section of the cementing collar of the present invention;

FIG. 2A is an expanded cross-section of FIG. 2 taken at A;

FIG. 2B is an expanded cross-section of FIG. 2 taken at B;

FIG. 3 is a partial cross section of the bottom plug;

FIG. 4 is a partial cross section of the top plug;

DESCRIPTION OF THE PREFERRED EMBODIMENT

Figure 5:
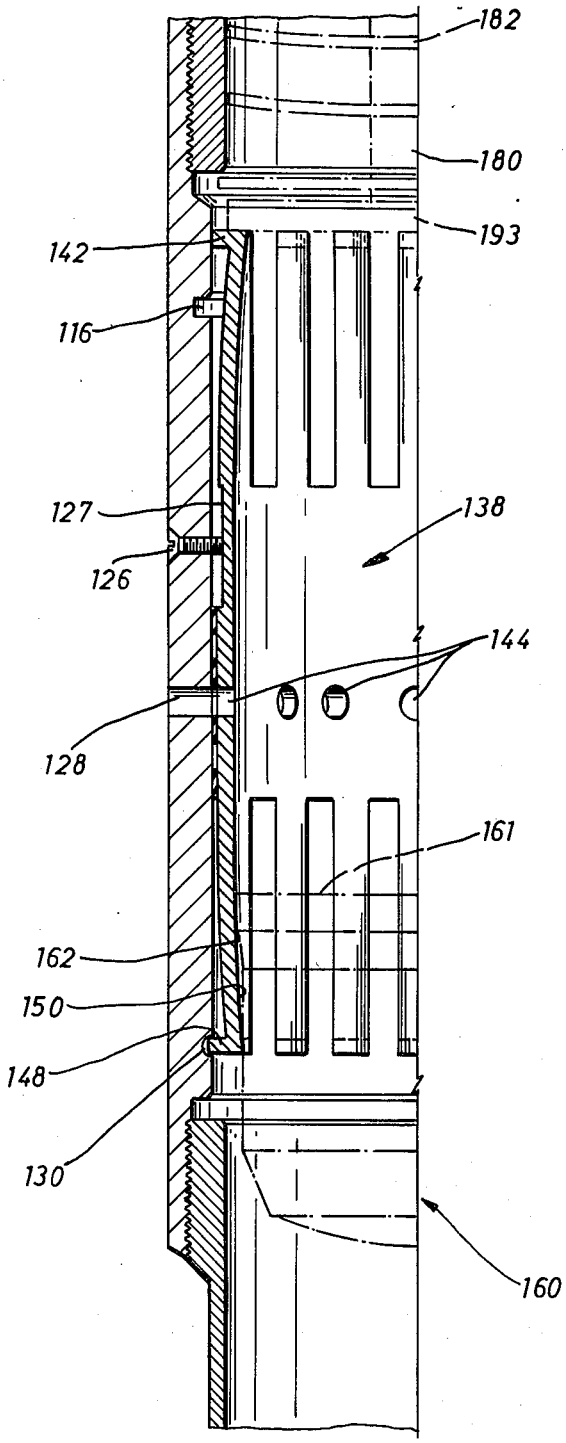
FIG. 5 shows the bottom plug inserted into the cementing collar of the present invention with the inner sleeve translated downwardly to an intermediate position.

Referring now to the drawings wherein like reference characters designate identical or corresponding parts throughout the several views, and more particularly to FIG. 1 thereof, a two-stage cementing collar apparatus 100 of the present invention is shown inserted in a conventional well bore 80, the upper portion of which may or may not be lined with a casing 82 extending to the surface. As is also conventional, the apparatus is attachable to a liner 84, which may be an elongated string of a plurality of interconnected tubular pipe sections sufficient to provide a liner of a desired length. The liner may be set in the well bore by any conventional means (not shown).

As shown in FIG. 2, the cementing tool of the present invention comprises an outer sleeve 106 threadedly attachable at each end thereof to sections of the liner 84. Circumferentially disposed about the inner surface 112 of the outer sleeve 106, is a first groove 108 defined by the lowermost portion of a section of the liner 84 and a cam surface 110. In addition to the groove 108, there also exists circumferentially distributed about the inner surface 112 of the outer sleeve 106 a second groove 116, with an associated cam surface 114, positioned between the groove 108 and a third groove 130. The groove 130 is defined by a semi-circular notch cut about the inner surface 112 of the outer sleeve 106. Furthermore, a fourth groove 134 is positioned axially below the groove 130 and is defined by cam surfaces 132 and 136.

Located between the first groove 116 and the third groove 130 are a plurality of outer sleeve ports 128 which extend through the width of the outer sleeve 106. Additionally, a lock pin 126 adapted to be received in a lock groove 127 located on the external surface of an inner sleeve 138 is provided for purposes hereinafter described.

Slidably disposed internally to the outer sleeve 106 is the inner sleeve 138. Extending axially upwardly from the inner sleeve 138 are a plurality of upper fingers 140 and extending axially downwardly from the inner sleeve 138 are a plurality of lower fingers 146. The upper fingers 140 and the lower fingers 146 define an upper collet ring 141 and a lower collet ring 147, respectively. The upper fingers 140 are adapted such that upper heads 142 engage the first groove 108 when the inner sleeve 138 is positioned within the outer sleeve 106 prior to initiation of the cementing operation. As shown in FIG. 2, when the upper heads 142 are disposed within the groove 108, lower heads 148 are in contact with the inner wall 112 of the outer sleeve 106. Both the upper fingers 140 and the lower fingers 146 are resilently flexible and are constructed such as to permit radial movement of these fingers, i.e., the fingers act as springs. Additionally, the spaces existing between adjacent fingers may be filled with a sealing material such as, for example, rubber to provide a pressure tight seal between the outer sleeve 106 and the upper and lower fingers. Furthermore, as shown in FIG. 2, the lower fingers 146, due to the spring action, define a lower finger angle of taper 150. FIG. 2A depicts, in expanded cross-section, one of the heads 142. As shown, the head 142 is constructed with cam surfaces **142*a* and 142*b* and flat surface 142*c* for purposes more fully described hereinafter. Additionally, FIG. 2B shows, in expanded cross-section, one of the heads 148. As shown, the head 148 is constructed with cam surfaces 148*a* and 148*b* and flat surface 148*c*** therebetween for purposes also hereinafter discussed.

In addition to the upper fingers 140 and the lower fingers 146, the inner sleeve 138 is provided with a plurality of openings 144 in the inner sleeve 138 distributed about the inner sleeve 138. Both the ports 128 in the outer sleeve 106 and the openings 144 in the inner sleeve 138 are suitably sized to permit the flow of fluid, such as cement slurry, therethrough.

Disposed between the inner sleeve 138 and the outer sleeve 106 are a plurality of seals 120, 122, 124 and 125 for providing a pressure tight seal between the inner sleeve 138 and the outer sleeve 106.

The inner sleeve 138 is slidably positionable within the outer sleeve 106 from a first locked to an intermediate to a second locked position. With the inner sleeve 138 in the first position, i.e. prior to initiation of the cementing process, the upper finger heads 142 are located in the first groove 108 and the openings 144 are axially out of register with the ports 128. With the upper heads 142 so positioned, the diameter of the upper collet ring 141 is subsantially equivalent to the diameter of the liner 84.

When it is desired to align the openings 144 with the ports 128, the inner sleeve 138 may be translated downwardly with respect to the liner 84 to an intermediate position in a manner more fully described hereinafter. Accordingly, during such downward translation the cam surfaces **142*b* of the upper heads 142 move first along the cam surface 110 until the surface 142*c* contacts the inner surface 112 of the outer sleeve 106. Simultaneously, the lower heads 148 translate along the inner surface 112 until engagement with the third groove 130 occurs (FIG. 5). Accordingly the cam surface 142*b* facilitates the movement of the inner sleeve 138 within the outer sleeve 106**.

Upon engagement of the lower heads 148 in the third groove 130, the ports 128 are radially aligned in register with the openings 144.

The groove 130 is adapted to receive the lower heads 148 thereby maintaining the inner sleeve 138 in the intermediate position. Further, the groove 130 is constructed such that with the lower heads 148 in the groove 130, the lower fingers 146 slightly expand radially causing a concommittant change in the lower finger angle of taper 150 and an increase in the diameter of the lower collet ring 147 when compared to the diameter of this ring with the inner sleeve 138 in the first locked position (FIG. 2). However, it is preferred that the groove 130 be constructed so as to assure that the diameter of the lower collet ring 147 measured with the lower heads 148 positioned in the groove 130 is less than the diameter of the liner 84. By way of example, with the lower heads 148 in the groove 130 the diameter may be approximately $\frac{1}{8}$ inch less than the diameter of the liner 84.

When it is desired to disalign the openings 144 from registration with the ports 128, the inner sleeve 138 may be further translated downwardly. Accordingly, the upper heads 142 move along the inner surface 112 until engaging the second groove 116. With the upper heads 142 in the groove 116, the diameter of the upper collet ring 141 is substantially equivalent to the diameter of the liner 84. Additionally, during translation of the inner sleeve from the intermediate to the second locked position, the lower heads 148 are displaced from the third groove 130, move along the inner surface 112 and engage the fourth groove 134 thereby causing the diameter of the lower collet ring 147 to be substantially equivalent to that of the liner 84.

In the preferred method of using the apparatus of the present invention the inner sleeve 138 is translated from the first locked to the intermediate position thereby bringing the ports and openings into register by inserting a bottom plug into the region of the lower fingers 146.

Referring now to FIG. 3, the bottom plug 160 is shown. The bottom plug 160 comprises an essentially tubular member with an upper body 161 thereof having a diameter slightly less than the diameter of the inner sleeve 138. A bottom plug upper angle of taper 162 is constructed such that the angle 162 is substantially equivalent to the lower finger angle of taper 150. Accordingly, when the bottom plug 160 is transported, for example by gravity, through the inner sleeve 138 the coincidental angles of taper 162 and 150 cause the plug 160 to be retained in the region of the lower fingers 146 when the inner sleeve is in the first locked position.

Disposed axially through the bottom plug 160 is a bore 174. The bore 174 contains a bottom plug ball 170, a retaining pin 168 for retaining the ball 170 within the bore 174 and a bottom plug ball seat 172. The lower portion of the bottom plug 160 is defined by a nose 166 which comprises a plurality of openings 167. The bottom plug 160 may be constructed such that the nose 166 is positioned adjacent the upper angle of taper 162. However, in order to facilitate transport of the plug 160 through the liner 84 and particularly through any fluid material existing therein, it is preferred that a lower body 163 of substantially cylindrical cross-section be constructed between the nose 166 and the angle of taper 162.

When the bottom plug 160 is transported downwardly through the liner 84 and the inner sleeve 138, any material existing within the liner or the inner sleeve 138, such as, for example, water, cement slurry, or any other fluid material, will flow in an upward direction through the openings 167 and around the ball 170 thereby permitting the bottom plug 160 to be easily inserted into and through the inner sleeve 138.

With the bottom plug thus inserted and retained in the lower collet ring 147, a hydraulic pressure directed along a longitudinal axis of the cementing collar 100 and toward the lowermost end thereof causes the ball 170 to contact the ball seat 172 resulting in a pressure tight seal. As one skilled in the art will readily appreciate, additional pressure upon the bottom plug 160 causes the upper finger heads 142 to be displaced from the first groove 108 with the cam surface **142*b* travelling along the cam surface 110. Further pressure causes the inner sleeve 138 and its associated upper and lower fingers to move in the direction of the second groove 116 until such time as the lower finger heads 148 engage the third groove 130. As will be appreciated, with the lower finger heads 148 in the groove 130, the lower fingers 146 will expand radially outwardly thereby slightly changing the lower finger angle of taper 150 and causing the bottom plug 160 to translate in a downward direction. However, due to the construction of the groove 130 the lower fingers 146 remain somewhat radially compressed such that the bottom plug 160 is retained in the lower collet ring 147**.

With the lower finger heads 148 positioned in the third groove 130, the openings 144 are radially aligned with the ports 128. Accordingly, cement slurry or other types of fluids may be circulated through the cementing collar 100 radially outwardly and into the well bore 80. The seal formed by the ball 170 in the ball seat 172 assures that no fluid is circulated to the liner 84 below the bottom plug 160.

Further, in order to assure that the openings 144 and the ports 124 remain capable of radial alignment both prior to and during the cementing operation, the lock pin 126 is receivable within the lock groove 127. The lock groove 127 may be a channel cut in the external surface of the inner sleeve 138. With the lock pin 126 positioned in the lock groove 127, the inner sleeve 138 is unable to rotate thereby assuring that the openings 144 and the ports 124 will not fall out of longitudinal alignment.

After the cementing operation is completed it is advantageous to remove the bottom plug 160 from the inner sleeve 138 without drill-out. As will be appreciated with the inner sleeve 138 in the intermediate position, i.e. the lower heads 148 in the groove 130, pressure directed on the upper surface of the plug 160 is ineffective in removing the top plug. If such pressure is thusly applied, the top plug 160 tends to force the lower fingers 146 radially outwardly. However, as previously mentioned, the groove 130 is constructed to assure that the diameter of the lower collet ring 147 is less than the diameter of both the liner 84 and the upper body 161 of the top plug 160 when the inner sleeve 138 is in the intermediate position. Thus, an axially directed force will only cause the plug 160 to be more firmly seated in the lower collet ring 147.

In order to assure that the plug 160 does not become so firmly seated in the lower collet ring 147 so as to be unable to be easily removed therefrom and further to easily remove the bottom plug 160 from the region of the inner sleeve 138, a force may be advantageously directed upon the upper finger heads 142 when the inner sleeve 138 is in the intermediate position. By so directing, the force is transmitted along the upper fingers 140, through the inner sleeve 138 and to the lower fingers 146 thereby causing the lower heads 148 to move out of the groove 130. Simultaneously, the plug 160 moves slightly upwardly along the tapers 162 and 150. With such displacement of the plug 160, the inner sleeve 138 is easily translated from the intermediate to the second locked position.

In the practice of the present invention, it is preferred that the force so directed upon the upper finger heads 142 be applied through the use of a top plug 178 which is inserted into the region of the inner sleeve 138 to cause the inner sleeve 138 to move downwardly into the second locked position such that the lower finger heads 148 are displaced from the third groove 130 and engage the fourth groove 134. Concurrently, the upper finger heads 142 engage the second groove 116 thereby assuring that the inner sleeve is firmly seated into the second locked position.

The top plug of the present invention is depicted in FIG. 4. The top plug 178 comprises a tubular body 180 with a plurality of generally cylindrical resiliently flexible wipers 182 distributed about the surface of the tubular body 180. The bottom of the top plug 178 is defined by a circumferentially disposed top plug seat 193 which may be made, for example, from a hard rubber material. The tubular body 180 contains an internally disposed retaining pin 190 and a top plug ball seat 194 located at the lowermost end of the tubular body 180. Movably locatable between the retaining pin 190 and the closing plug ball seat 194 is a top plug ball 192. The diameter of the ball 192 is less than that of the tubular body 180 thereby permitting the top plug 178 to be easily inserted into the inner sleeve 138 as previously described with respect to the bottom plug 160. As will be readily appreciated, the top plug 178 may simply be pumped through the liner 84 and hence to the inner sleeve 138.

Figure 6:
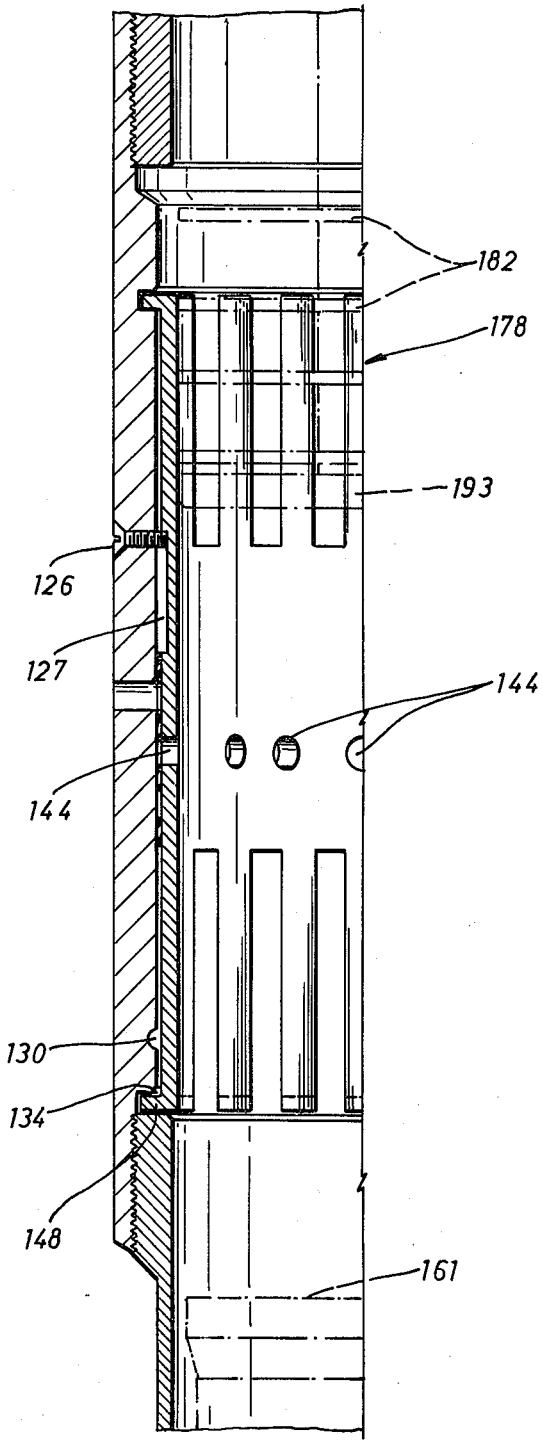
FIG. 6 shows the inner sleeve translated downwardly to a locked position.

Referring now to FIG. 5, the lower finger heads 148 are engaged in the groove 130 with the openings 144 and the ports 128 thereby being radially aligned. When it is desired to disalign the ports 128 from the openings 144 and concurrently remove the bottom plug 160 from its position within the cementing collar 100, the top plug 178 is inserted into the liner 84 until the seat 193 abuts the uppermost surface of the upper finger heads 142. Insertion of the top plug 178 may be occasioned by simply dropping the plug 178 into the liner 84 or by attaching the plug 178 to a drill pipe. Application of hydraulic pressure upon the top plug 178 so positioned causes the top plug ball 192 to be positioned on the top plug ball seat 194 thereby sealing the tubular member 180. Additional pressure on the top plug 178 forces the lower finger heads 148 to be disengaged from the third groove 130 followed thereafter by downward translation of the inner sleeve 138, the bottom plug 160 and the top plug 178. This downward translation continues until the lower finger heads 148 engage the lower fourth groove 134 and, simultaneously, the upper finger heads 142 engage the second groove 116 as depicted in FIG. 6. As will be appreciated, with the lower finger heads engaged in the fourth groove 134, the lower fingers 146 radially expand such that the diameter of a cross section taken along the line of the lower finger heads 148 is substantially equivalent to the diameter of the liner 84. Thus with no resistance afforded to the bottom plug 160 along the bottom plug upper taper 162, the bottom plug is free to fall to the bottom of the well bore. Additionally, as the inner sleeve 138 translates downwardly the openings 144 are radially aligned with the seal 125 thereby resulting in a pressure tight seal and sealing the openings 144 from communication through the ports 124.

Removal of the top plug is obtained by merely pushing the plug to the bottom of the well casing utilizing a drill pipe, tubing or weight attached to, for example, a wire line.

As previously described, the cementing collar of the present invention may be opened or closed simply by the use of a bottom and/or top plug and hydraulic pressure directed upon the appropriate plug. Accordingly, the present invention does not require rotation or manipulation of the liner 84 and therefore removes from consideration problems that may be associated with such manipulation and/or rotation.

While the present invention has been described with respect to a preferred embodiment and certain alternatives thereto, it should be understood that one skilled in the art may make modifications to the present invention while still falling within the scope and spirit of the invention.

What is claimed is:

1. A method for cementing the bore holes of oil or gas wells comprising a. providing at one or more suitable points along the length of the well liner a cementing collar comprising a pair of cylindrical sleeves slidably positioned one within the other each having a suitable number of spaced portholes adapted to permit the forcing of a slurry of cement into the annular space outside the well liner when the portholes in the two sleeves are in register;

said cylindrical sleeves situated in a first locked position such that the portholes are aligned circumferentially but not axially, the portholes of the inner sleeve being displaced a distance above the portholes of the outer cylinder;

b. inserting into the well liner a generally cylindrically shaped bottom plug designed to fall freely down the well liner but adapted to be engaged and stopped by the inner cylindrical sleeve of the cementing collar when it is in the first locked position thereby sealing off the well bore against a fixed hydraulic pressure;

c. applying a first hydraulic pressure through the well liner sufficient to cause the inner sleeve and plug to move downwardly in the well to a second position wherein the portholes of the inner and outer cylindrical sleeves of the cementing collar are in alignment;

d. pumping cementing slurry downward into the well liner and out through the portholes of the drilling collar sleeves to effect cementing of the bore hole;

e. inserting a cylindrical top plug into the well liner designed to be pumped down to and engage the top of the inner cylindrical sleeve when the inner sleeve is in the second position thereby sealing off the bottom plug against a fixed hydraulic pressure; and thereafter f. applying a second hydraulic pressure through the well liner sufficient to force the inner sleeve and bottom plug out of the second position and cause them to move downwardly in the well to a third position thereby closing and sealing the port holes against communication with the well bore outside the liner and wherein the bottom plug is disengaged from the inner sleeve and released to fall freely to the well bottom.

2. Apparatus for use in cementing of oil or gas well bore holes and adapted to provide a plurality of portholes which can be opened and closed through the use of hydraulic pressure, which comprises:

an outer tubular member threaded at each end for attachment to sections of well liner, said outer tubular member having a plurality of circumferentially spaced portholes located intermediate the length thereof and extending radially therethrough the inside surface of the outer tubular member being provided with a series of four circumferential grooves suitably positioned two above and two below the plurality of portholes;

an inner tubular member slidably disposed with respect to said outer tubular member and having a plurality of circumferentially spaced openings extending radially therethrough and adapted to align identically with the portholes of said outer tubular member, the inner tubular member having an upper array of resiliently flexible fingers forming an upper collet ring, each of the fingers having an upper head and also having a lower array of resiliently flexible fingers forming a lower collet ring, each of the fingers having a lower head, the collet ring of the inner tubular member adapted to engage and be held by a circumferential groove on the inside surface of the outer tubular member;

the circumferential grooves of said outer tubular member being further defined in that they are sized and spaced in relation to the outer diameter and distance between the two collet rings of the inner tubular member such that when said inner tubular member is in a locked position, the upper heads are received in a first groove, the lower heads abut the interior of said outer tubular member at a location above a third groove with said lower fingers thereby defining a holding surface adapted to receive an opening means and said openings are spaced axially out of register with said ports, with said inner tubular member movably positioned in an intermediate position, the upper heads, adapted to receive a closure means, are disposed in abutting relationship to the inner surface of the outer member, the lower heads are received in a third groove and said portholes and said openings are radially aligned in register and with the inner tubular member movably disposed in a second locked position said upper heads are received in a second groove, said lower heads are received in a fourth locking groove and said openings are spaced axially out of register with said ports;

a locking means for preventing rotation of the inner tubular member with respect to said outer tubular member while at the same time permitting axial movement thereof; and a plurality of seals positioned in spaced apart relation between said outer and said inner tubular members.

3. The apparatus of claim 2, wherein said locking means comprises a pin extending through said outer tubular member receivable in an axial channel located on the external surface of said inner tubular member.

4. The apparatus of claim 2, wherein said opening means comprises an elongated substantially tubular bottom plug with an upper portion thereof having a larger cross sectional diameter than a lower portion thereof and defining a tapered surface therebetween, said tapered surface adapted to be received by said holding surface, an axial bore existing through the longitudinal axis of said plug and containing a first check valve therewithin with the lowermost end of said bore and said plug coincidentially defining a fluid opening.

5. The apparatus of claim 2, wherein said closure means comprises an elongated substantially tubular top plug with a plurality of resiliently flexible wipers circumferentially spaced about a longitudinal axis of said top plug, with one end of said top plug defining a seat adapted for abutting contact on said upper finger heads when said second tubular member is in said intermediate position, an axial bore existing through said top plug containing a second check valve therewithin.

6. The apparatus of claim 4, wherein said first check valve comprises a substantially spherical ball movably positioned within said axial bore, a retaining pin for retaining said ball in said bore, and a ball seat adapted to receive said ball thereby producing a pressure tight seal within said axial bore.

7. The apparatus of claim 5, wherein said second check valve comprises a substantially spherical ball movably positioned within said axial bore, a retaining pin for retaining said ball in said bore, and a ball seat adapted to receive said ball thereby producing a pressure tight seal within said axial bore.

* * * * *

UNITED STATES PATENT AND TRADEMARK OFFICE

CERTIFICATE OF CORRECTION

PATENT NO. : 4,176,717

DATED : December 4, 1979

INVENTOR(S) : Harold A. Hix

It is certified that error appears in the above-identified patent and that said Letters Patent are hereby corrected as shown below:

Column 2, line 13, after "assigned" insert --to--.

Column 4, line 8, delete "is" and insert --in--.

Signed and Sealed this

*First* Day of *July 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,176,717

DATED : December 4, 1979

INVENTOR(S) : Harold A. Hix

It is certified that error appears in the above-identified patent and that said Letters Patent are hereby corrected as shown below:

Column 1, line 66, after "carried on" insert --,--.

Column 3, line 68, delete "threadly" and insert --threadedly--.

Column 5, line 38, delete "resilently" and insert --resiliently--.

Column 6, line 6, delete "subsantially" and insert --substantially--.

Signed and Sealed this

*Twenty-eighth* Day of *October 1980*

[SEAL]

*Attest:*

SIDNEY A. DIAMOND

*Attesting Officer*

*Commissioner of Patents and Trademarks*